US006378745B1

(12) United States Patent
De Luccia

(10) Patent No.: US 6,378,745 B1
(45) Date of Patent: Apr. 30, 2002

(54) KNIFE HOLSTER FOR A HAND

(76) Inventor: Dominic R. De Luccia, 1842 Colden Ave., Bronx, NY (US) 10462

( * ) Notice: Subject to any disclaimer, the term of this patent is extended or adjusted under 35 U.S.C. 154(b) by 0 days.

(21) Appl. No.: 09/663,128

(22) Filed: Sep. 15, 2000

(51) Int. Cl.[7] ..... A45C 11/00
(52) U.S. Cl. ..... 224/218; 30/16; 224/232
(58) Field of Search ..... 224/218, 219, 224/222, 232; 30/160

(56) References Cited

U.S. PATENT DOCUMENTS

| | | | | | |
|---|---|---|---|---|---|
| 3,693,375 | A | | 9/1972 | Paulsen | |
| 4,069,954 | A | * | 1/1978 | Rauch | 224/218 |
| D251,569 | S | | 4/1979 | Johnson | |
| D271,160 | S | | 11/1983 | Sherwin | |
| 5,002,213 | A | | 3/1991 | Newton et al. | |
| 5,421,498 | A | | 6/1995 | Menoni | |
| 5,442,855 | A | * | 8/1995 | Jobin | 30/160 |
| 5,446,953 | A | * | 9/1995 | LeFeber | 224/218 |
| 5,593,073 | A | * | 1/1997 | Finnegan | 224/219 |
| 5,791,705 | A | * | 8/1998 | Romero et al. | 224/218 |
| 5,823,409 | A | | 10/1998 | Kennedy | |
| 5,878,500 | A | * | 3/1999 | Emerson | 224/232 |
| 5,938,089 | A | * | 8/1999 | Abreu-Marston | 224/222 |
| 5,967,391 | A | * | 10/1999 | Hunt | 224/222 |
| 5,971,240 | A | * | 10/1999 | Dequaine | 224/218 |
| 6,146,319 | A | * | 11/2000 | Tarail | 224/219 |

* cited by examiner

*Primary Examiner*—Stephen P. Garbe

(57) ABSTRACT

A knife holster for a hand for holding and supporting a blade between the user's fingers. The knife holster for a hand includes a knife having a handle and a blade pivotally and lockingly attached to the handle; and also includes a strap assembly being adapted to fasten about a user's hand and being adapted to support the knife upon the user's hand.

11 Claims, 2 Drawing Sheets

KNIFE HOLSTER FOR A HAND

BACKGROUND OF THE INVENTION

1. Field of the Invention

The present invention relates to a hand-fastened knife support member and more particularly pertains to a new knife holster for a hand for holding and supporting a blade between the user's fingers.

2. Description of the Prior Art

The use of a hand-fastened knife support member is known in the prior art. More specifically, a hand-fastened knife support member heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,421,498; U.S. Pat. No. 5,823,409; U.S. Pat. No. 5,002,213; U.S. Pat. No. 3,693,375; U.S. Pat. No. Des. 251,569; and U.S. Pat. No. Des. 271,160.

While these devices fulfill their respective, particular objectives and requirements, the aforementioned patents do not disclose a new knife holster for a hand. The inventive device includes a knife having a handle and a blade pivotally and lockingly attached to the handle; and also includes a strap assembly being adapted to fasten about a user's hand and being adapted to support the knife upon the user's hand.

In these respects, the knife holster for a hand according to the present invention substantially departs from the conventional concepts and designs, of the prior art, and in so doing provides an apparatus primarily developed for the purpose of holding and supporting a blade between the user's fingers.

SUMMARY OF THE INVENTION

In view of the foregoing disadvantages inherent in the known types of hand-fastened knife support member now present in the prior art, the present invention provides a new knife holster for a hand construction wherein the same can be utilized for holding and supporting a blade between the user's fingers.

The general purpose of the present invention, which will be described subsequently in greater detail, is to provide a new knife holster for a hand which has many of the advantages of the hand-fastened knife support member mentioned heretofore and many novel features that result in a new knife holster for a hand which is not anticipated, rendered obvious, suggested, or even implied by any of the prior art hand-fastened knife support member, either alone or in any combination thereof.

To attain this, the present invention generally comprises a knife having a handle and a blade pivotally and lockingly attached to the handle; and also includes a strap assembly being adapted to fasten about a user's hand and being adapted to support the knife upon the user's hand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new knife holster for a hand which has many of the advantages of the hand-fastened knife support member mentioned heretofore and many novel features that result in a new knife holster for a hand which is not anticipated, rendered obvious, suggested, or even implied by any of the prior art hand-fastened knife support member, either alone or in any combination thereof.

It is another object of the present invention to provide a new knife holster for a hand which may be easily and efficiently manufactured and marketed.

It is a further object of the present invention to provide a new knife holster for a hand which is of a durable and reliable construction.

An even further object of the present invention is to provide a new knife holster for a hand which is susceptible of a low cost of manufacture with regard to both materials and labor, and which accordingly is then susceptible of low prices of sale to the consuming public, thereby making such knife holster for a hand economically available to the buying public.

Still yet another object of the present invention is to provide a new knife holster for a hand which provides in the apparatuses and methods of the prior art some of the advantages thereof, while simultaneously overcoming some of the disadvantages normally associated therewith.

Still another object of the present invention is to provide a new knife holster for a hand for holding and supporting a blade between the user's fingers.

Yet another object of the present invention is to provide a new knife holster for a hand which includes a knife having a handle and a blade pivotally and lockingly attached to the handle; and also includes a strap assembly being adapted to fasten about a user's hand and being adapted to support the knife upon the user's hand.

Still yet another object of the present invention is to provide a new knife holster for a hand that gives the user more control of the knife when being used for cutting.

Even still another object of the present invention is to provide a new knife holster for a hand that provides a weapon for self-defense purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
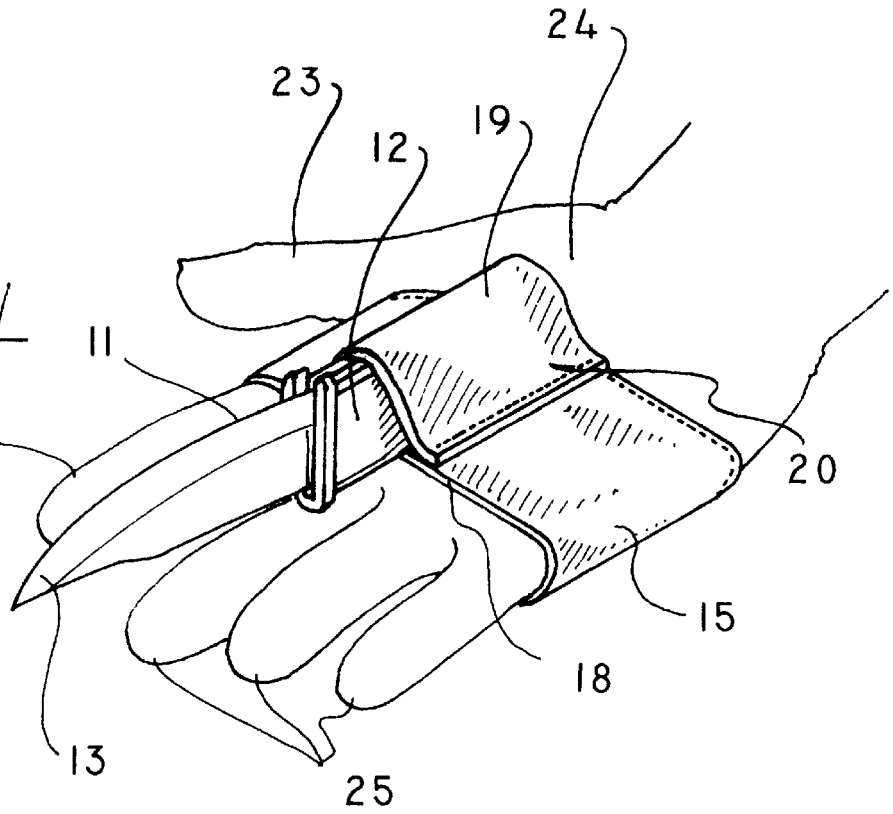
FIG. 1 is a perspective view of a new knife holster for a hand according to the present invention and shown being fastened to a user's hand.
Figure 2:
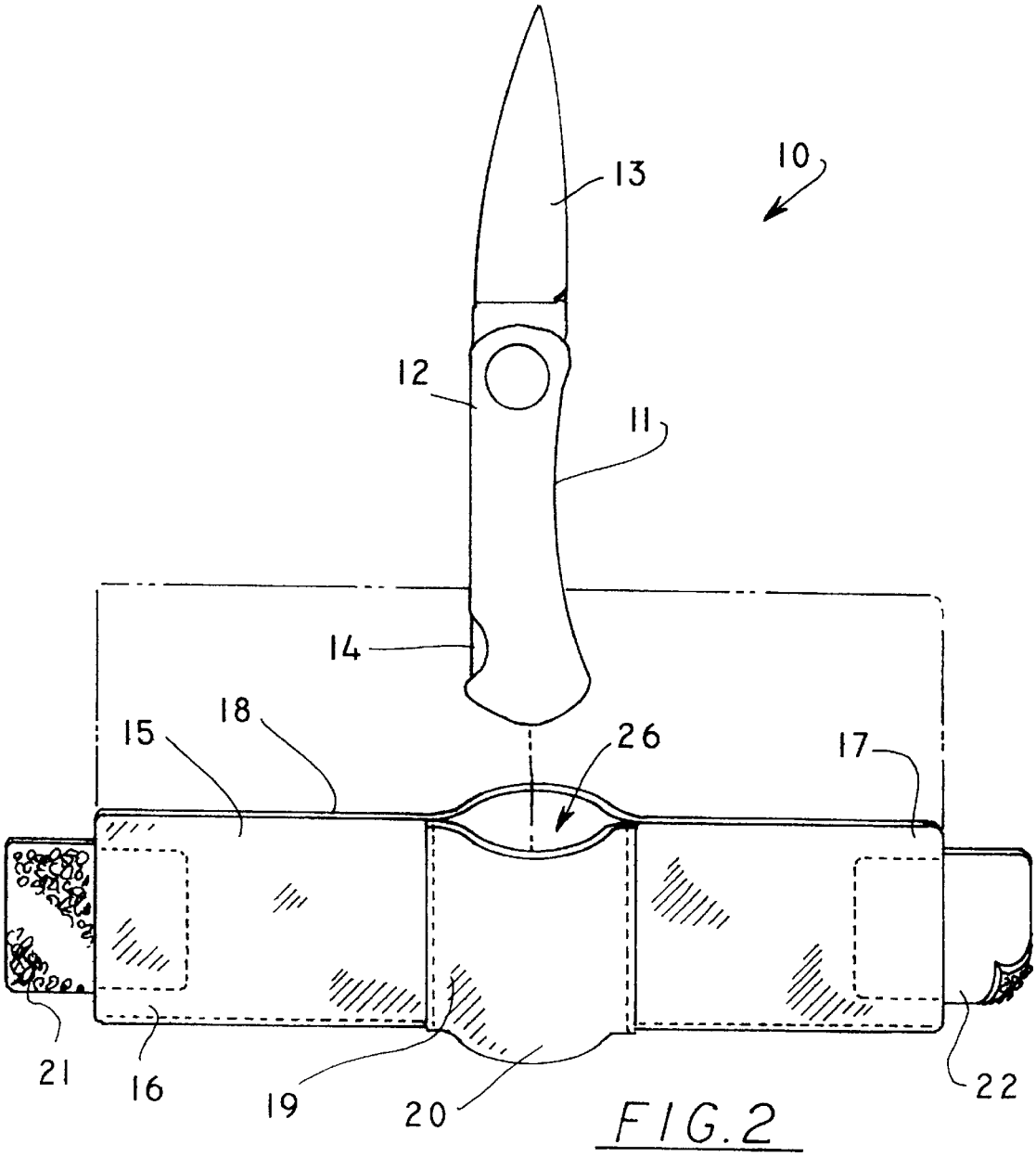
FIG. 2 is an exploded side elevational view of the present invention.

With reference now to the drawings, and in particular to FIGS. 1 through 2 thereof, a new knife holster for a hand embodying the principles and concepts of the present invention and generally designated by the reference numeral 10 will be described.

As best illustrated in FIGS. 1 through 2, the knife holster for a hand 10 generally comprises a knife 11 having a handle 12 and a blade 13 pivotally and lockingly attached to the handle 12 with the knife 11 including a lock release member 14 depressibly and conventionally disposed in a wall of the handle 12 and being adapted to pivotally release the blade 13 from the handle 12. The blade 13 is pivotally closed and received in the handle 12 for the storing thereof with the blade 13 being approximately 2 3/16 inches long.

A strap assembly is adapted to fasten about a user's hand 23 and is adapted to support the knife 11 upon the user's hand 23. The strap assembly includes a strap member 15 having an outer side and an underside, and also includes a pocket member 19 being securely and centrally and conventionally attached to the outer side and being adapted to receive and hold the handle 12 of the knife 11 therein with the blade 13 extending outwardly from the pocket member 19; and further includes fastening members 21,22 being securely and conventionally attached at ends 16,17 of the strap member 15. The pocket member 19 includes a portion of the strap member 15 and a strip of material 20 being sewn along a perimeter thereof to, the outer side of the strap member 15 with the pocket member 19 being laterally disposed of the strap member 15. The pocket member 19 has an open end 26 which is disposed along a front longitudinal edge 18 of the strap member 15 with the pocket member 19 essentially being opened to the front longitudinal edge 18 of the strap member 15. The fastening members 21,22 include strips of hook and loop fasteners being securely and conventionally attached to the ends 16,17 of the strap member 15 and being fastenable onto one another about the user's hand 23 with the blade 13 being extendable forward of the front longitudinal edge 18 of the strap member 15 upon the knife 11 being securely received in the pocket member 19 through the open end 26 thereof. The pocket member 19 is adapted to be disposed upon a palm 24 of the user's hand 23 with the blade 13 being extended along the fingers 25 of the user's hand 23. The strap member 15 is approximately 7 inches long and 1½ inches wide.

In use, the user fastens the strap member 15 about one's hand 23 with the pocket member 19 being disposed upon the palm 24 of one's hand 23, and the user then inserts the handle 12 of the knife 11 into the pocket member 19 with the blade 13 being extended outwardly of the pocket member 19 and between the fingers 25 of one's hand 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A knife holster for a hand comprising:

a knife having a handle and a blade pivotally and lockingly attached to said handle; and a strap assembly for fastening about a user's hand and supporting said knife upon the usre's hand;

wherein said knife includes a lock release member depressibly disposed in a wall of said handle and being adapted to pivotally release said blade from said handle, said blade being pivotally closed and received in said handle for the storing thereof;

wherein said strap assembly includes a strap member having an outer side and an underside, and also includes a pocket member being securely and centrally attached to said outer side receiving and holding said handle of said knife with said blade extending outwardly from said pocket member; and further includes fastening members being securely attached at ends of said strap member; and wherein said pocket member includes a portion of said strap member and a strip of material being sewn along a perimeter thereof to said outer side of said strap member with said pocket member being laterally disposed of said strap member.

2. A knife holster for a had as described in claim 1, wherein said pocket member has an open end which is disposed along a front longitudinal edge of said strap member, said pocket member essentially being opened to said front longitudinal edge of said strap member.

3. A knife holster for a hand as described in claim 1, wherein said fastening members includes strips of hook and loop fasteners being securely attached to said ends of said strap member and being fastenable onto one another about the user's hand.

4. A knife holster for a hand as described in claim 2, wherein said blade is extendable forward of said front longitudinal edge of said strap member upon said knife being securely received in said pocket member through said open end thereof.

5. A knife holster for a hand as described in claim 1, wherein said pocket member is adapted to be disposed upon a palm of the user's hand with said blade being extended along the fingers of the user's hand.

6. A knife holster for a hand comprising;

a knife having a handle and a blade pivotally and lockingly attached to said handle, said knife including a lock release member depressibly disposed in a wall of said handle and being adapted to pivotally release said blade from said handle, said blade being pivotally closed and received in said handle for the storing thereof, said blade being approximately 2 3/16 inches long; and a strap assembly being adapted to fasten about a user's hand and being adapted to support said knife upon the user's hand, said strap assembly including a strap member having an outer side and an underside, and also including a pocket member being securely and centrally attached to said outer side and being adapted to receive and hold said handle of said knife with said blade extending outwardly from said pocket member; and further including fastening members being securely attached at ends of said strap member, said pocket member including a portion of said strap member and a strip of material being sewn along a perimeter thereof to said outer side of said strap member with said pocket member being laterally disposed of said strap member, said pocket member having an open end which is disposed along a front longitudinal edge of said strap member, said pocket member essentially being opened to said front longitudinal edge of said strap member, said fastening members including strips of hook and loop fasteners being securely attached to said ends of said strap member and being fastenable onto one another about the user's hand, said blade being extendable forward of said front longitudinal edge of said strap member upon said knife being securely received in said pocket member through said open end thereof, said pocket member being adapted to be disposed upon a palm of the user's hand with said blade being extended along the fingers of the user's hand, said strap member being approximately 7 inches long and 1½ inches wide.

7. In combination:

a knife having a handle and a blade pivotally attached to the handle;

a knife holster for mounting the knife to a user's hand, said knife holster comprising:

a strap assembly for fastening about a user's hand and mounting said knife upon the user's hand;

wherein said strap assembly includes a strap member having an outer side and an underside, and also includes a pocket member being substantially centrally attached to said outer side for receiving and holding said handle of said knife with said blade extending outwardly from said pocket member, said strap assembly further including fastening members attached at ends of said strap member; and wherein said pocket member includes a portion of said strap member and a strip of material being attached along a perimeter of the strip to said outer side of said strap member with said pocket member being laterally disposed of said strap member;

wherein said knife includes a lock release member depressibly disposed in a wall of said handle for releasing said blade from said handle, said blade being pivotally movable into said handle for the storing thereof.

8. The combination of claim 7, wherein said pocket member has an open end which is disposed along a front longitudinal edge of said strap member, said pocket member being open to said front longitudinal edge of said strap member.

9. The combination of claim 7, wherein said fastening members includes strips of hook and loop fasteners being attached to said ends of said strep member and being fastenable onto one another about the user's hand.

10. The combination of claim 7, wherein said pocket member is positionable on a palm of the user's hand with said blade being extended along the fingers of the user's hand.

11. The combination of claim 7, wherein said blade is extendable forward of a front longitudinal edge of said strap member upon said knife being received in said pocket member through said open end thereof.

* * * * *